US007770244B2

(12) United States Patent
Yeh

(10) Patent No.: US 7,770,244 B2
(45) Date of Patent: Aug. 10, 2010

(54) SOAP-DISPENSING FAUCET STRUCTURE

(75) Inventor: Jackson B Yeh, Changhua Hsien (TW)

(73) Assignee: Pony Sanitary Ware Industrial Corporation, Changhua Hsien (TW)

( * ) Notice: Subject to any disclaimer, the term of this patent is extended or adjusted under 35 U.S.C. 154(b) by 643 days.

(21) Appl. No.: 11/790,097

(22) Filed: Apr. 23, 2007

(65) Prior Publication Data

US 2008/0256702 A1 Oct. 23, 2008

(51) Int. Cl.
*E03C 1/04* (2006.01)

(52) U.S. Cl. ..... 4/675; 4/676; 4/903; 239/289; 222/192

(58) Field of Classification Search ..... 4/903, 4/675–677, 597; 239/289, 333, 583; 222/192, 222/173, 321.7, 129, 144.5
See application file for complete search history.

(56) References Cited

U.S. PATENT DOCUMENTS 2,302,097 A * 11/1942 Beckman ..... 134/88
2,477,998 A * 8/1949 McCowan ..... 239/310
3,713,585 A * 1/1973 Conklin ..... 239/307
3,720,352 A * 3/1973 Kozlowski ..... 222/132
4,625,896 A * 12/1986 Rocchelli ..... 222/180
6,390,340 B1 * 5/2002 Lynch, Sr. ..... 222/399
6,718,568 B1 * 4/2004 Hensley ..... 4/675
6,827,294 B1 * 12/2004 Fan et al. ..... 239/310
6,910,604 B2 * 6/2005 Gugliotti et al. ..... 222/179.5

FOREIGN PATENT DOCUMENTS

GB 2370799 A * 7/2002

* cited by examiner

*Primary Examiner*—Khoa D Huynh
(74) *Attorney, Agent, or Firm*—Alan Kamrath; Kamrath & Associates PA

(57) ABSTRACT

A soap-dispensing faucet structure comprises an upright cylindrical faucet body, having a spout extending outwards at the front side, and a tube seat at one side of the lower section to which a core shaft, a locking cap, and a faucet handle are sequentially mounted thereto. The upper section of the faucet has an appropriate-depth receiving chamber to which a sleeve cover and a pump device are combined to form an individual soap-receiving accommodation space. The lower section of the faucet has a set of cold and hot water ducts and an outlet tube that are fluidly connected to the core shaft of the tube seat to provide another individual water-discharging chamber linked to the spout to form a water influx-and-outflow circuit to be switched on and off by the faucet handle, providing a concise and whole depth-extending visual effect, and easier assembly and maintenance of the soap-dispensing faucet thereby.

8 Claims, 6 Drawing Sheets

SOAP-DISPENSING FAUCET STRUCTURE

BACKGROUND OF THE INVENTION

The present invention relates to a soap-dispensing faucet structure, comprising a cylindrical faucet body having an upper section defined by an appropriate-depth receiving chamber with which a sleeve cover and a pump device are combined to form an individual soap-receiving accommodation space, and a lower section equipped with a set of cold and hot water ducts and an outlet tube that are fluidly connected to a core shaft of a tube seat to provide another individual water-discharging chamber communicating with a spout to form a water influx-and-outflow circuit that can be switched on and off by a faucet handle, providing a unique spatial design with concise and whole depth-extending visual effects as well as easier assembly and maintenance of the soap-dispensing faucet thereby.

Please refer to FIG. 5 showing an exploded perspective view of a conventional faucet with a soap dispenser accompanied by FIG. 6). A conventional faucet with a soap dispenser includes a faucet body 70 having an elongated round seat body 71 extending at one side wherein the seat body 71 has a bore 711 drilled there-through, and the bore 711 has the interior defined by internal screw threads 712 to which a cleaning liquid dispenser 80 is locked to provide a faucet structure with a soap dispenser thereby. The cleaning liquid dispenser 80 is made up of a push head 801, a cap 802, a straw 803, an axle sleeve 804, a plug 805, a flexibly rebound element 806, a ball 807, a tube seat 81, bent coupling tubes 82, a hose 83, and a cleaning liquid reservoir 84.

There are some drawbacks to such conventional faucet structure. First of all, the cleaning liquid dispenser 80 is exposed to fix outside the faucet body 70. And the press head 801 is simply secured at one end and the other end thereof must be joined to the bent coupling tubes 82 and the hose 83 so as to connect to the cleaning liquid reservoir 84 thereby. In assembly, depending on the location of the cleaning liquid reservoir 84, the hose 83 must be preset for a certain length to be guided and installed onto the cleaning liquid reservoir 84. As a result, the hose 83 can easily get hooked or wound up and hinder the smooth emission of the cleaning liquid thereof. In other cases, the push head 801 must be pressed long and hard before the cleaning liquid is squeezed outwards for application. Furthermore, if the cleaning liquid is not used regularly and kept to stay a long time in the bent coupling tubes 82 and the hose 83, moisture in the atmosphere can easily get through the tiny chinks disposed at the conjoining sections of the multiple tubing thereof to humidify and deteriorate the cleaning liquid contained therein. Thus, the deteriorated cleaning liquid can easily breed bacteria therein, which is quite inconvenient and unhygienic in application. Second, the elongated round seat body 71 with the bore 711 defining thereon is provided extending at one side of the faucet body 70 for the fixing of the cleaning liquid dispenser 80 thereto, which inevitably increase the volume of the faucet body 70 as well as the cost of production thereof. Besides, the bore 711 drilled onto the seat body 71 is provided simply for the accommodation of the push elements of the cleaning liquid dispenser 80; the bent coupling tubes 82 and the hose 83 are also required to match to the cleaning liquid reservoir 84. Thus, the conventional faucet with a soap dispenser is complicated in structure and time-consuming in assembly. In addition, it also occupies a lot of space, which makes it look rather awkward in appearance.

SUMMARY OF THE PRESENT INVENTION

It is, therefore, the primary purpose of the present invention to provide a soap-dispensing faucet structure, comprising an upright cylindrical faucet body having an upper section defined by an appropriate-depth receiving chamber to which a sleeve cover and a pump device are joined to form an individual soap-receiving accommodation space that is separated from another individual faucet water-discharging space disposed at the lower section of the faucet body, combining the upper and lower spaces into one integral unit wherein the soap-receiving accommodation space forms a depth-extending accommodating chamber that not only increases its capacity to contain liquid soap, but also facilitates speedy filling or refilling of the liquid soap, significantly reducing the cost of production and the space occupied as well as facilitating speedy assembly and maintenance thereby.

It is, therefore, the second purpose of the present invention to provide a soap-dispensing faucet structure wherein the faucet matched to a handle is combined with the soap-receiving accommodation space to form a set of integral but separate upper and lower chambers so that the water-discharging or the soap-dispensing can be flexibly operated in individual spaces without hindering each other, efficiently boosting the convenience of application thereby. In addition, a spout and a tube seat with the faucet handle mounted thereto are provided to respectively extend perpendicularly to the faucet body, while the pump device with the sleeve cover is mounted to extend on top of the receiving chamber of the faucet body, providing a unique spatial design with concise and whole depth-extending visual effects as well as achieving a safe and hygienic soap-dispensing faucet structure thereby.

DETAILED DESCRIPTION OF THE PREFERRED EMBODIMENTS

Figure 1:
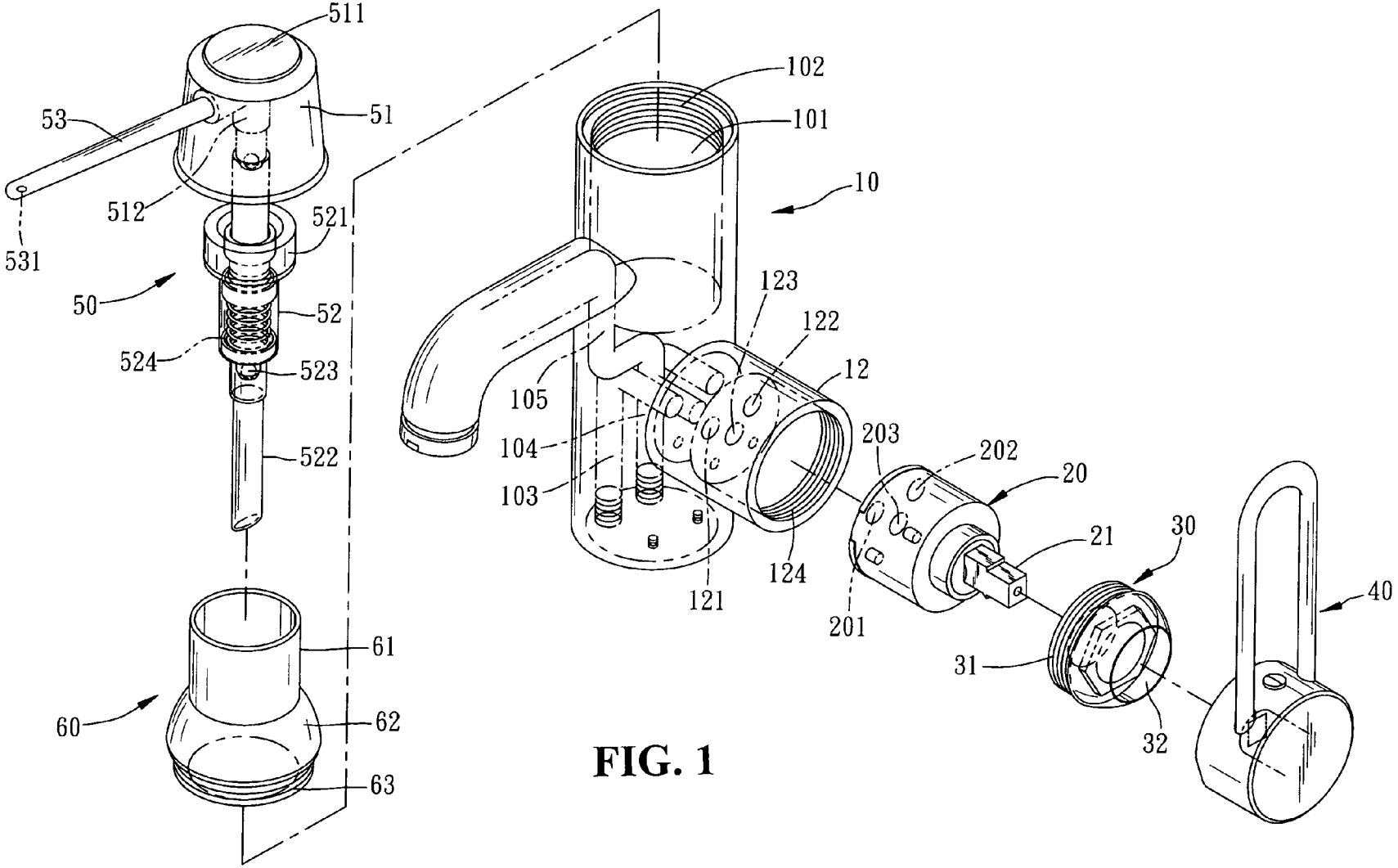
FIG. 1 is an exploded perspective view of the present invention.

Please refer to FIG. 1 showing an exploded perspective view of the present invention. The present invention relates to a soap-dispensing faucet structure, comprising a faucet body 10, a core shaft 20 equipped with a spindle 21, a locking cap 30, a faucet handle 40, a pump device 50 and a sleeve cover 60. The faucet body 10 is molded into a cylindrical tube shape, having an arched spout 11 extending perpendicularly outwards for an appropriate length at the front of the upper section thereon, and a tube seat 12 extending perpendicularly outwards at one side of the lower section thereon wherein the tube seat 12 is defined by an appropriate-depth cavity with an internal-threaded locking section 124 disposed at the end edge thereon, to which the core shaft 20, the locking cap 30 having a central coupling hole 32 and an external-threaded locking section 31 defining one end thereon, and the faucet handle 40 are sequentially guided and mounted thereto. The faucet body 10 includes an upper opening end and an appropriate-depth receiving chamber 101 preset at the upper section thereon, and the receiving chamber 101 has an inner-threaded portion 102 defining the internal opening edge thereon, and an enclosure side extending at the bottom thereon to separate from the space disposed at the lower section of the faucet body 10 thereby. The lower section of the faucet body 10 is equipped with a set of cold and hot water ducts 103, 104 and an outlet tube 105 wherein the cold and hot water ducts 103, 104 have one ends extending to the bottom edge of the faucet body 10 to fluidly connect to a set of cold and hot water inlet pipes 103', 104' respectively, and the other ends extending to join to a set of cold and hot water inlet orifices 121, 122 of the tube seat 12 thereof so that the core shaft 20 equipped with a set of cold and hot water inlet apertures 201, 202 can also be fluidly linked thereto to form a cold and hot water influx passage thereby. The outlet tube 105 has one end extending to the rear section of the spout 11 to provide a water outflow conduit thereby, and the other end extending to fluidly connect to an outlet port 123 of the tube seat 12 so as to communicate with an outlet aperture 203 of the core shaft 20 and form a water inflow-and-outflow circuit thereby. The pump device 50 is made up of a press head 51 and a pump tubing 52 equipped with a flexibly rebound element 524. The press head 51 has a push button 511 disposed at the top and a bifurcated coupling tube 512 disposed at the bottom thereon wherein the bifurcated coupling tube 512 has one end joined to a liquid-guiding conduit 53 with a dispensing hole 531 disposed thereon, and the other end connected to the pump tubing 52 with the flexibly rebound element 524 mounted thereon. The pump tubing 52 has an axle sleeve 521 disposed at an appropriate position of the upper section, an appropriate-length suction conduit 522 extending at the lower section thereon, and a ball 523 adapted to flexibly abut against both upper and lower ends thereon respectively. The sleeve cover 60 has an upper section molded into an appropriate-depth and hollow cylindrical body 61, and a lower section shaped into a larger stepwise and hollow arcuate cap body 62 with an appropriate-length and outer-threaded locking portion 63 extending at the bottom end thereon.

Figure 2:
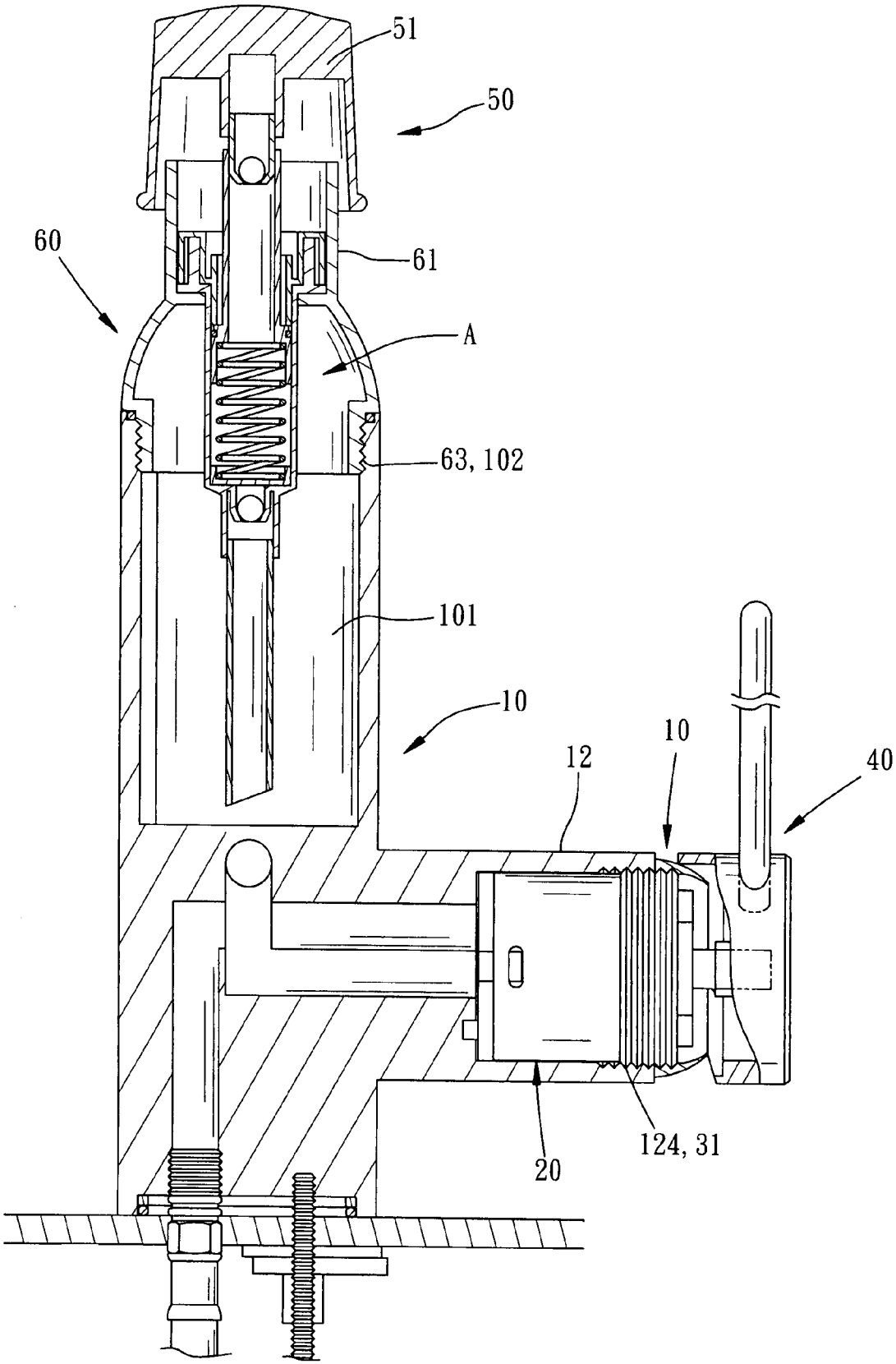
FIG. 2 is an assembled cross sectional view of the present invention.
Figure 3:
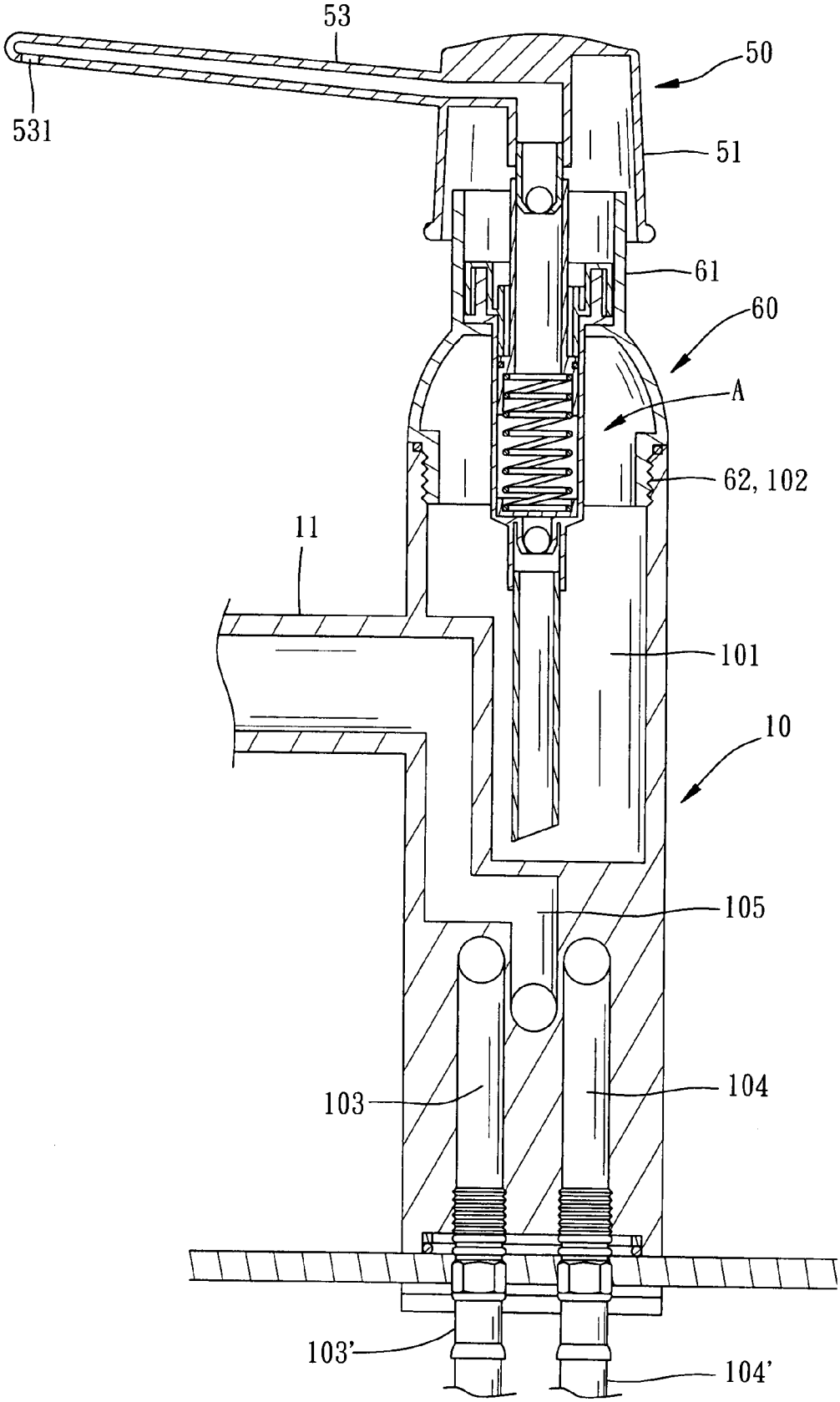
FIG. 3 is another assembled cross sectional view of the present invention.

Please refer to FIGS. 2, 3 showing assembled cross sectional views of the present invention. In assembly, the core shaft 20 is guided to mount into the tube seat 12 of the faucet body 10, permitting the cold and hot water inlet apertures 201, 202 thereof to respectively match to the cold and hot water ducts 103, 104 fluidly connected to the cold and hot water inlet orifices 121, 122 of the tube seat 12, and the outlet aperture 203 thereof to the outlet tube 105 thereof. Then, the other ends of the cold and hot water ducts 103, 104 extending at the bottom of the faucet body 10 are respectively coupled with the cold and hot water inlet pipes 103', 104' to form a water influx-and-outflow passage in a water flow circuit. Meanwhile, the core shaft 20 is fitted into the tube seat 12, and the external-threaded locking section 31 of the locking cap 30 is secured to the internal-threaded section 124 of the tube seat 12, permitting one end of the spindle 21 passing through the coupling hole 32 thereof to extend outside the locking cap 30 for an appropriate length. Then, the faucet handle 40 is mounted to the spindle 21 to complete the assembly of the faucet handle 40 as well as form an individual water supply chamber thereby. Then, the outer-threaded locking portion 63 of the sleeve cover 60 is secured to the inner-threaded portion 102 of the faucet body 10, permitting the receiving chamber 101 to combine with the sleeve cover 60 and form an integral and depth-extending accommodation space A that also provides another individual soap-receiving accommodation space A thereby. Thus, cleaning liquid soap required can be filled into the soap-receiving accommodation space A, and the pump tubing 52 of the pump device 50 is mounted into the sleeve cover 60 with the axle sleeve 521 precisely engaged and stopped therein. The suction conduit 522 extending at the end section of the pump tubing 52 is then allowed to accurately extend down into the lower section of the soap-receiving accommodation space A, completing the assembly of a soap-dispensing faucet thereby.

Figure 4:
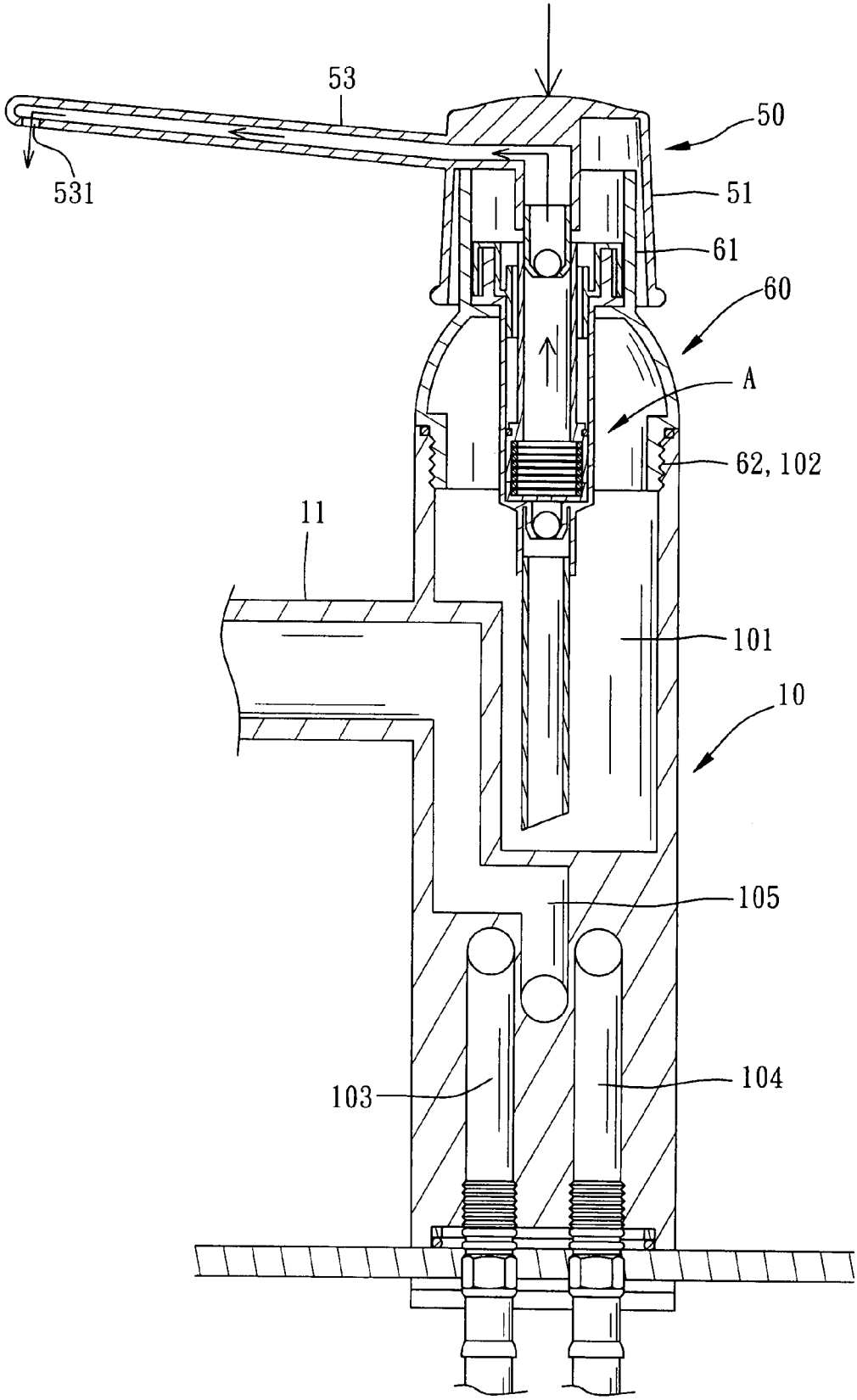
FIG. 4 is a diagram showing the present invention in application.
Figure 5:
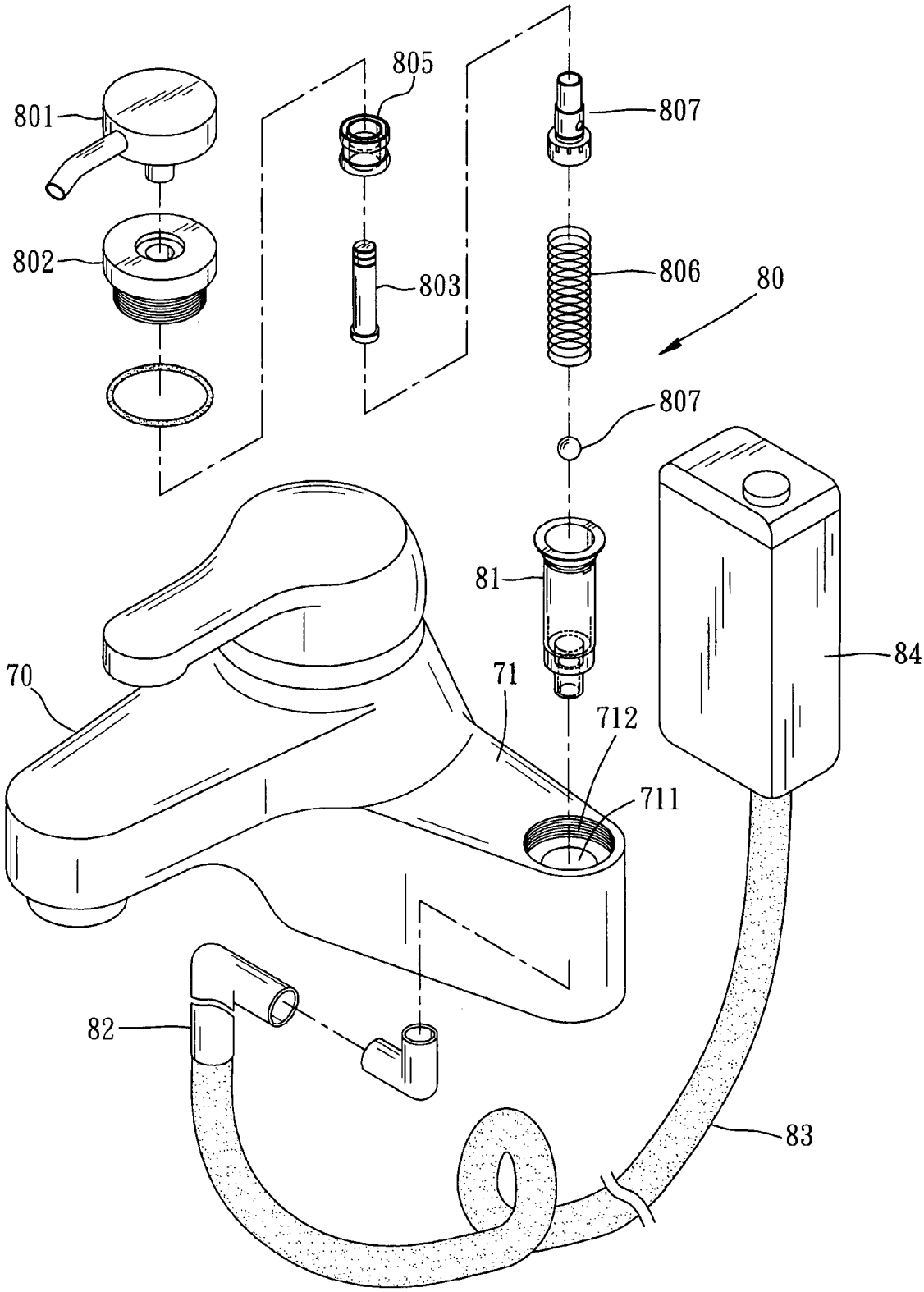
FIG. 5 PRIOR ART
FIG. 5 is an exploded perspective view of a conventional faucet with a soap dispenser.
Figure 6:
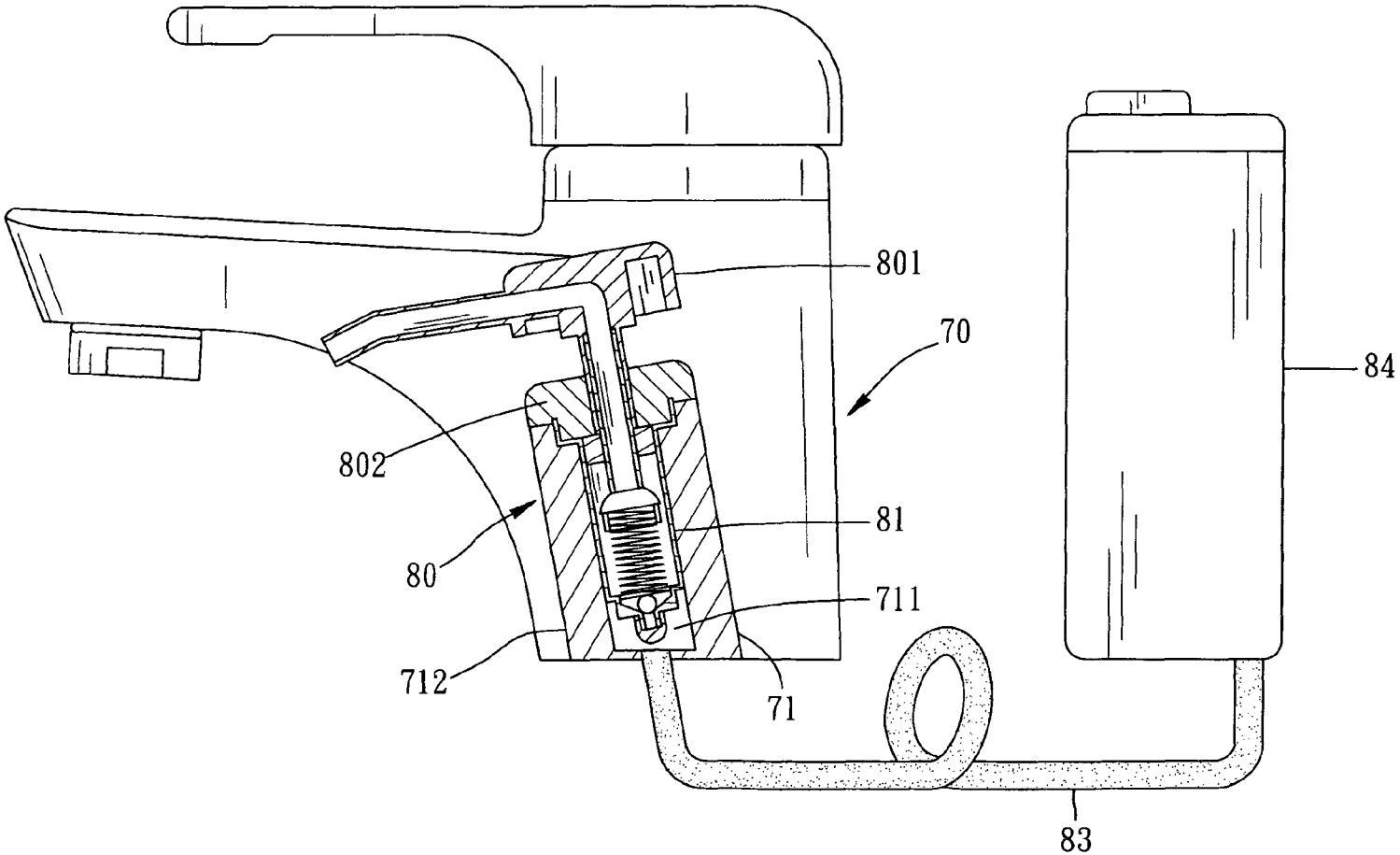
FIG. 6 PRIOR ART
FIG. 6 is an assembled cross sectional view of the conventional faucet structure.

Please refer to FIG. 4 showing the present invention in the state of application thereof. In application, the push button 511 disposed on top of the press head 51 of the pump device 50 is pushed, and, via the flexibly rebound element 524 and the siphon effect thereof, the cleaning liquid soap received in the accommodation space A therein is sucked up through the suction conduit 522 and transferred to pass through the pump tubing 52, the bifurcated coupling tube 512, and the liquid-guiding conduit 53 in a sequence to be transported outwards via the dispensing hole 531 thereof. Furthermore, the soap-receiving accommodation space A is divided from the faucet water-discharging chamber disposed below to form an upper-and-lower separation-type design thereby. Therefore, depending on the requirement of users, the pump device 50 can be separately applied to dispense liquid soap for use, or the faucet handle 40 be individually switched to open water discharge for application thereof. Otherwise, the pump device 50 can be squeezed to have some liquid soap dispensed first before the faucet handle 40 extending at the other side of the faucet body 10 is bent and switched on, permitting the water flow to discharge outwards via the spout 11 for cleaning purpose. Then, after the cleaning thereof, the faucet handle 40 can be re-bent to switch off the water discharge and complete the cleaning operation thereby.

To fill or refill the cleaning liquid soap thereof, the pump device 50 is directly pulled and retrieved to open the accommodation space A so that the cleaning liquid can be filled or refilled into the accommodation space A therein. Then, the pump tubing 52 of the pump device 50 is mounted back to the sleeve cover 60 with the axle sleeve 521 precisely engaged and stopped therein, and the suction conduit 522 at the end section of the pump tubing 52 accurately extending down into the lower section of the accommodation space A therein, completing the filling or refilling of the liquid soap thereby.

What is claimed is:

1. A soap-dispensing faucet structure, comprising: a faucet body having an upper section, a core shaft equipped with a spindle, a locking cap, a faucet handle, a pump device and a sleeve cover;

wherein said faucet body has an arched spout extending for an appropriate length at the front of said upper section thereon, and a tube seat defined by an appropriate-depth cavity extending outwards at one side of the lower section thereon; said faucet body also includes an upper opening end disposed above said arched spout, said upper opening end having an appropriate-depth receiving chamber preset at said upper section of said faucet body thereon, and said appropriate-depth receiving chamber has an inner-threaded portion defining an internal opening edge thereon; said faucet body also has a lower section including a bottom edge, said lower section equipped with a set of cold and hot water ducts and an outlet tube wherein said cold and hot water ducts have one ends extending to said bottom edge of said faucet body and the other ends extending to join to a set of cold and hot water inlet orifices of said tube seat thereof;

wherein said pump device is made up of a press head and a pump tubing equipped with a flexibly rebound element, wherein said press head has a push button disposed at the top and a bifurcated coupling tube disposed at the bottom thereon; said bifurcated coupling tube has one end joined to a liquid-guiding conduit with a dispensing hole disposed thereon, and the other end connected to said pump tubing with said flexibly rebound element mounted thereto; said pump tubing also has an axle sleeve disposed at an upper section of said pump tubing and above said flexibly rebound element, an appropriate-length suction conduit locating below said flexibly rebound element and extending from an end section of said pump tubing, and a ball locates underneath said flexibly rebound element and flexibly abuts against both upper and lower ends thereon respectively;

wherein said sleeve cover has an upper section molded into an appropriate-depth and hollow cylindrical body, and a lower section shaped into a larger stepwise and hollow arcuate cap body with an appropriate-length outer-threaded locking portion extending at the bottom end thereon;

wherein said core shaft is accommodated and guided to mount into said tube seat extending at one side of said lower section, and said locking cap is secured to said tube seat before said faucet handle is mounted to said spindle protruding at one side of said core shaft to form an individual water supply chamber that is fluidly connected to said arched spout of said faucet body to provide a water influx and outflow circuit thereby; then, said sleeve cover is locked to said inner-threaded portion defining said upper opening end of the faucet body, permitting said receiving chamber combining with said sleeve cover and forming an integral and depth-extending accommodation space which also provides an individual soap-receiving accommodation space thereby; then, said pump tubing of said pump device is guided through said sleeve cover with said axle sleeve precisely engaged and stopped therein, and said suction conduit located at the end section of the pump tubing extending downwards into a lower portion of said individual soap-receiving accommodation space therein; therefore, said faucet body is combined to form a set of integral but separate upper and lower sections, wherein said upper section defined by said appropriate-depth receiving chamber to which said sleeve cover and said pump device are joined to form said individual soap-receiving accommodation space therein and said lower section in conjunction with said tube seat defining another individual faucet water-discharging space disposed at said lower section of said faucet body, which not only offer a whole and concise depth-extending visual effect with minimum space occupied thereby, but also facilitate easier assembly and maintenance to provide a neat and hygienic faucet structure with both soap-dispensing and water-discharging functions integrated into said body faucet.

2. The soap-dispensing faucet structure as claimed in claim 1 wherein the faucet body is molded in a cylindrical tube shape.

3. The soap-dispensing faucet structure as claimed in claim 1 wherein the arched spout of the faucet body is molded into an arched tube and extends forwards perpendicularly to the faucet body.

4. The soap-dispensing faucet structure as claimed in claim 1 wherein the tube seat is disposed at one side of the faucet body and extends perpendicularly to the faucet body.

5. The soap-dispensing faucet structure as claimed in claim 1 wherein the tube seat has the cavity defined by a locking section at the end edge thereon.

6. The soap-dispensing faucet structure as claimed in claim 5 wherein the locking section of the cavity is molded into an internal-threaded locking section.

7. The soap-dispensing faucet structure as claimed in claim 1 wherein the receiving chamber disposed at the upper section of the faucet body has an inner-threaded portion defining the internal opening edge thereon and an enclosure side disposed at the bottom thereon to separate from the space disposed at the lower section of the faucet body thereby.

8. The soap-dispensing faucet structure as claimed in claim 1 wherein the cold and hot water ducts extending at the lower section of the faucet body have the end portions respectively coupled with a set of cold and hot water inlet tubes thereby.

* * * * *